US005259505A

United States Patent [19]

Sobel

[11] Patent Number: 5,259,505

[45] Date of Patent: Nov. 9, 1993

[54] INTERFITTING IMAGE DISPLAY BOX WITH TOP PROTRUSION AND BOTTOM RECESS

[76] Inventor: Roger Sobel, 1833 Lombard, San Francisco, Calif. 94123

[21] Appl. No.: 893,373

[22] Filed: Jun. 3, 1992

[51] Int. Cl.[5] ..... B65D 21/00

[52] U.S. Cl. ..... 206/509; 206/504

[58] Field of Search ..... 206/8, 504, 509, 515

[56] References Cited

U.S. PATENT DOCUMENTS

| | | | |
|---|---|---|---|
| 2,496,093 | 1/1950 | Zwata | 206/509 |
| 3,214,052 | 10/1965 | Dike | 206/509 |
| 3,270,922 | 9/1966 | Schmidt | 206/509 |
| 3,587,904 | 6/1971 | Harris | 206/509 |
| 3,819,847 | 6/1974 | Charles | 206/509 |
| 4,691,828 | 9/1987 | Slusarczyk et al. | 206/509 |
| 4,805,793 | 2/1989 | Brandt et al. | 206/509 |
| 5,137,146 | 8/1992 | Stonehouse | 206/509 |

*Primary Examiner*—Joseph Man-Fu Moy

[57] ABSTRACT

An interfitting image display box (FIGS. 1, 12) is made of a top (FIGS. 2, 13) and a bottom (FIGS. 3, 4, 14, 15). The top lifts off completely (FIGS. 2, 13), or is hinged to permit lifting the box top back or the side (not shown), or that can be closed (FIGS. 1, 12) and that can then be stacked one on top of the other (FIGS. 10, 11, 16, 17, 18). A box can be made of any material—wood, metal, plastic, papers, and in any shape—rectangular (FIGS. 1–18), square, triangular, round or eliptical. The boxes interfit one into the next one above in such a way as to secure an entire stack of boxes—one on top of the other—either empty or filled with any product of choice FIGS. 9, 10, 11, 16, 17, 18. The top of the interfitting box incorporates a protruding molded image or logo FIGS. 1, 2, 5, 6, 7, 10, 11, 12, 13, 16, 17, 18. The bottom of the box has a molded recess or cavity to accommodate the protruding molded image or logo on the top of the box below FIGS. 3, 4, 7, 10, 14, 15, 16, 17. The entire stack of boxes can be placed on a pallet that contains a part that interlocks to the bottom box (not shown). The molded protrusion on top of the box can suggest the product enclosed, or display a promotion item that enhances the product(s) enclosed.

6 Claims, 7 Drawing Sheets

FIG. 7
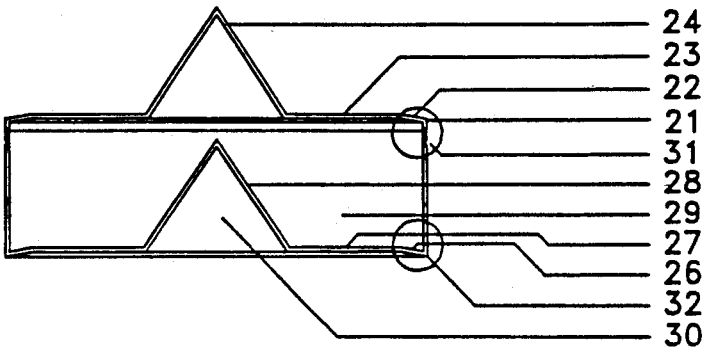
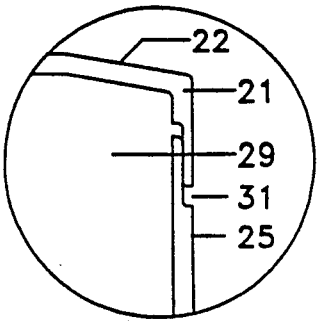
FIG. 9
FIG. 8
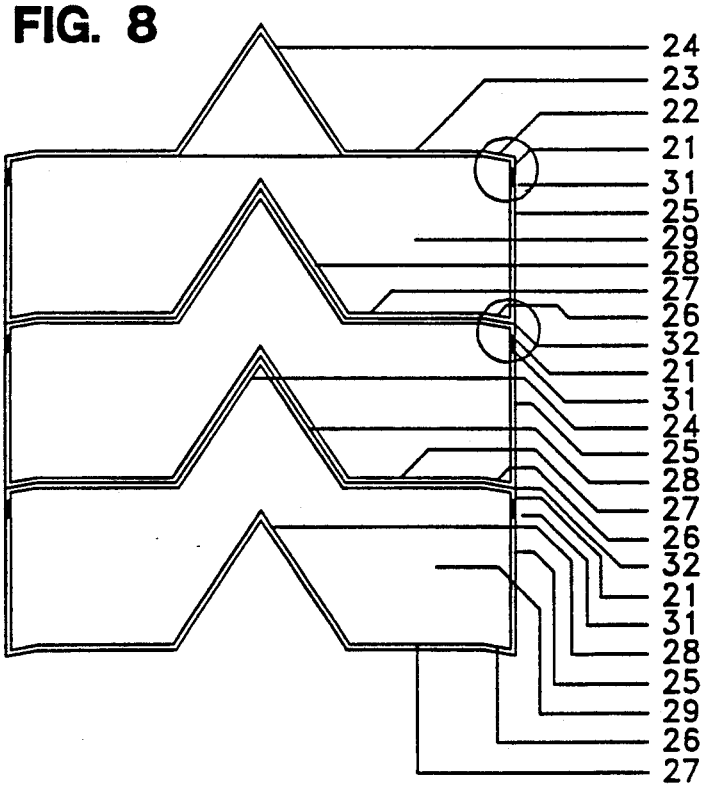
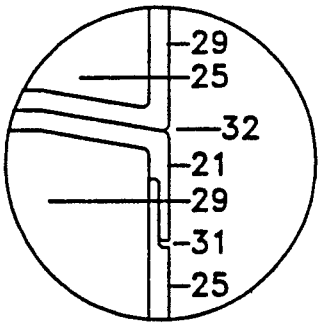
FIG. 10

INTERFITTING IMAGE DISPLAY BOX WITH TOP PROTRUSION AND BOTTOM RECESS

BACKGROUND

1. Field of the Invention

This invention relates to packaging, particularly to molded setup stackable image display packaging boxes.

2. Description of Prior Art

Boxes generally are of two forms: "folding boxes" that are produced, shipped, and stored with the tops bottoms, and sides folded flat, and then are set-up at the location of use; and, "set-up boxes" that are sold in a three-dimensional, box-like, assembled form. Conventional boxes are generally made of cardboard in a limited number of shapes and configurations. For example, rectangular, round, heart, oval, octagonal, and square. These boxes are generally flat on the top, bottom, and all side surfaces. Most boxes that are used for packaging and that suggest the contents inside the box (through labeling or through putting the top of the box on the bottom therefore exposing the contents, and then covering the entire arrangement with cellophane or shrink wrap) are conventional, no matter what their configuration, size, or materials. Such boxes do not provide any additional aesthetic attibutes.

The more usual the shape—square or rectangular, the more likely the box will be of the folding type, made of one piece, and opened by unfolding one end. The more typical "set-up boxes" have separate tops and bottoms, and are opened by lifting the top from the bottom. If the box contains an item, it is generally sealed with some sort of cellophane or plastic shrink wrap in order to prevent tampering with the contents. Or, in the case of contents of more expensive items, such as cosmetics, there is frequently a "window" of plastic or cellophane. The contents of the box can be viewed through this "window" without breaking the seal.

In the case of even more expensive items, or items that have a wide range of quality, color, or composition, the bottom of the box containing the contents might be wrapped in cellophane, or shrink wrapped. This allows prospective purchasers to view the contents without disturbing them. In this instance, the top of the box may be left on and the entire box may then again be wrapped in cellophane or shrink wrap plastic. Or, the top of the box may be removed and turned over so that the bottom of the box is set into the top of the box, and the entire contents and both parts of the box are then sealed in a shrink wrap.

The conventional box is made of cardboard. The more expensive the box and its contents, the more enhancements that are usually made to the basic cardboard box. For example, the box may be covered with a "skin" of paint, paper, plastic or fabric which is applied in some manner directly onto the structural cardboard. The next most expensive version is a box has a top and/or a bottom that appears to be "wrapped" in paper, plastic, or fabric materials.

The next most expensive will be a high quality "skin" or "wrapped" material, with nesting dividers in the bottom section. Such boxes generally have an aesthetic ornament attached to the top, such as ribbons, a sprig of holly or mistletoe, or a toy. Boxes for expensive chocolates frequently have a rose or another flower made of fabric attached to the top of the box.

There are a number of boxes that are made of cardboard or lightweight wood or metal that are hinged, allowing the user to simply lift back the top without detaching it from the box.

In conventional packaging, the contents of the boxes are advertised by labels on the outside of the box, and/or on the outside of the shrink wrap or cellophane-sealed covering. In some cases the shape of the box is so familiar that outside labeling may not even be required even though it is usually present, such as a milk carton, a fishing tackle box, or a brief case. And, in other cases, the item(s) itself may be shrink wrapped in clear plastic. Still other boxes have a clear plastic "bubble" or a "window" that reveals the contents easily to the purchaser.

As to storing, shipping, inventorying, and displaying, there are a number of examples of "nesting" containers that are molded that fit together in a box in such a way that the optimal number of units can fit within a box with a minimal amount, or wasted "dead space." However, there is nothing aesthetic, or definitive about those containers, even though they are quite practical, frequently accommodating a handle in the cavity that admits the nesting feature.

In addition, there are a number of examples of the products "nesting" together in layers such as in fruit and egg cartons in a master box.

Another example is the plastic container for face masks such as those used for Halloween costumes. (Goldberg, U.S. Pat. No. 4,453,629, Jun. 12, 1984) These plastic containers "sandwich" the face masks between clear, rigid, molded top and bottom containers. These containers must be hung on a stem for display. Stacking of these masks is difficult. The container must be made of impermeable plastic. The hygienic advantage of the protective packaging of the face mask is enjoyed only by the ultimate purchaser. The purchasers and all other shoppers before them have been exposed to the potential contamination from all prior shoppers "trying on" the mask packaging. Therefore the underlying premise is defeated by the very package that was designed for hygienic reasons.

The foregoing "mask" package requires transparency, plastic, and is limited to that particular product. All "masks" must be exactly the same in order to nest. Unlike masks are not likely to nest, therefore defeating the second purpose, to compactly ship, store, and display the product.

The mask package example shape also consumes virtually the entire surface, front and back, leaving flat only the very edges that fit the front and back of the container together. This reduces space for information about the product, advertising, discriptive inducements, pricing, and bar coding. Finally, the mask container is not reusable for any other product or use.

Conventional boxes are generally stacked on shelves and must be taken down in order to see the top labels, contents, and designs. In the event that a projecting decorative item has been added to the top of the box, it is impracticable to stack them one on top of the other without an accommodating frame or space to protect the decorative item on top of the box. In addition, a frame is required to keep the box sufficiently level to prevent sliding and toppling of stacks of the boxes. The most typical example is the Valentine's Day heart shaped box of candy with a floral arrangement on top.

Frequently, conventional boxes do not stack well one on top of the other (without the risk of sliding or toppling over) because of the "convex curve" that was created when the shrink wrap or the cellophane wrap was added to the box. Therefore many conventional boxes are placed on their short side, one beside the other like books. This type of display and storage prevents the sliding and toppling problem and the advertising opportunities on top of the boxes. This also makes the advertising and information printed on the side of the box difficult to read. Of course this type of display—on the side of the box—requires row end supports to prevent the entire row from sliding or toppling over. Otherwise retailers are forced to provide display shelving in order to accommodate the horizontal writings on the side of boxes that stack in that manner.

Conventional boxes generally require shelves on which to display them commercially, either stacked or standing on their side. In warehouse types of commercial settings, conventional boxes can be left in their master box as consumers remove them from that shipping box.

When a box is unusually shaped, for example when the top is shaped like an egg, a separate sleeve must be provided to enclose the egg-shaped top. (Brecher, U.S. Pat. No. 3,826,359, Jul. 30, 1974) The additional sleeve surrounds and supports the egg-shaped top in an upright position. This type of container generally requires that the entire bottom be shaped in the manner of the entire top that is completely convex, limiting the advertising and product information space. In addition, the types of products that can be contained within is restricted to wrinkleable items, such as stockings and undergarments, or food. Another embodiment of the same concept takes on a square shape, that also permits nesting. In both instances, the top of the box is the entire unusual shape. Such containers also lack advertising area and readability and visibility of advertising copy. These containers are not reusable. These containers are generally handled a great deal in the marketplace because of the variety of choices in the product, e.g., the size, color, texture, styles, and types of stockings.

Another familiar example is a velvet or satin jewelry box that frequently has a curved molded top, which is invariably enclosed in another box that has square corners, such as a rectangle or a square.

There are a number of containers that generally contain liquids that are stackable and have a "nesting" feature that permits the top and neck of the container below to fit into an indentation in the lower side of the container above (A. P. J. Wiseman, U.S. Pat. No. 3,391,824, Jul. 9, 1968) This type of container wastes space in shipping, storing, and displaying, because no matter how they are stacked, there is dead space on the side of every other layer when the containers are arranged. The stackability of the number of such containers is greatly limited, because they can be interlocked only one row deep; the ratio of base to height is restrictive; weight of the product is required to keep the stack upright; the recess in the bottom and the projection of the top cap, neck, and handle on the top are too shallow to assure a sufficient interlock to stabilize the stack. In the one instance (Brandt, et al, U.S. Pat. No. 4,805,793, Feb. 21, 1989) one container can only be placed one on top of the other. In the other instance, the interlocking can only be accomplished side to side, for as long a row as is deemed acceptable, and then "pyramided" to one bottle on top if desired. Therefore, the nesting stability is questionable. This stacking method also greatly limits the quantity of inventory that can be displayed, being wider at the base than at the top.

Other containers that stack, are stacked one on the top of the other. These containers are unstable, because when one is stacked on top of the other, the size, shape, contents, and materials that make up the container fail to provide stability. These containers do nest in that the top, neck, and frequently the handle nest in a cavity in the bottom of the container above. The depth of the fitting is too shallow to provide adequate stability so that there is a risk of the entire stack toppling.

Still other containers exists that are generally more attractive, and which occasionally take on unusual shapes, usually to package foods (H. R. Weiss, U.S. Pat. No. 3,322,267, May 30, 1964). These containers are undesirable because there is dead space, regardless of the configuration between the containers for shipping, storing, and displaying. Because these containers do not interlock in some fashion, they cannot be easily displayed. Frequently such containers require additional packaging to protect the contents, the package, and to prevent slippage during shipping and handling, and consequently increasing the cost. The very nature of the contents of these packages requires that the container be disposable. Most of the containers are not reusable.

Summarized, none of the current packaging—such as the mask, while nesting, fails to provide stackability to a significantly applicable (economical effectiveness) degree. The nesting stability is questionable and limited in all instances of stackability. All of the patents reviewed are severely restricted to their individual use. None are capable of being used in a variety of applications more than a multiple of 2. All of the prior art must be exactly the same front and back or top and bottom in order to nest. Flat boxes generally must be stored horizontal or vertical, thereby reducing the exposure of the advertising on the top of the box, or additional shelf space is required to display the box on a diagonal support. Most products require waterproof containers to keep moisture out or liquids in and are generally made of plastic or covered with cellophane or shrink wrap plastic. Most of the current packaging and patents reviewed are not ecologically acceptable, in that they are generally made of plastic or require cellophane or plastic sealing and are not generally reusable.

OBJECTS AND ADVANTAGES

Accordingly, several objects and advantages of the present invention include uniqueness, versatility, flexibility, and a stable stacking feature. There are no boxes on the market today that provide the variety, interlocking feature, uniqueness, the quality, the suggestion of the content of the box, the flexibility of design, the variety of manufacturing materials, or the romance of the interfitting image display box. The options of the interfitting image display box are limitless.

This invention is a sharp contrast to the state-of-the-art of today's packaging ability to display the promotion image, suggest the contents of the box, provide assurance of hygienic contents, allow adequate advertising and marketing information on the container, and encourage reuse of the interfitting box by the end user. The interfitting image display box provides a new attention-getting approach to marketing a product by getting the jump on the market.

The interfitting image display box can be displayed as one assembled unit or as a stack of several assembled units. The single interfitting box is as attractive when displayed, as when stacked with several assembled units. The unique interfitting box with the unique protrusion encourages the purchaser to keep and reuse the interfitting box for the same or the purposes. Therefore the interfitting image display box is an ecologically sound product.

The interfitting image display box was designed in order to incorporate unique designs into the top of each box, augment and permit the design of unique packaging shapes, allow for economical production, shipping, storage, and display in an effective manner. The boxes can be of any shape and size, made of virtually any material, can be filled with a variety of items, or they may be sold empty for individual wholesale needs. Each interfitting box incorporates a unique logo or image on the top. The very concept of the interfitting box encourages innovative shapes.

The interfitting image display box can be manufactured by a broad range of applications of metal, plastic, cellulose, paper board, and any and all other materials. The interfitting image display box can be easily shipped, stored, inventoried, displayed, and sold. The combination of beveled and flat surfaces, and the protrusion on top, when fitted against the corresponding bottom of the box on top, assures stackable stability. The top interlocks into the bottom of the box above, preventing slipping and toppling during shipping, storing, and displaying same. The bottom recess can be generic and can accommodate a variety of different protrusions from the top of the interfitting box below. Or the bottom recess can be specific and conform exactly to the protrusion from the top of the interfitting box below. In either case, the stackability and stability of a stack of these unique boxes, is assured. The compact interlocking fit of one assembled interfitting box to the one above and below assures a less cumbersome arrangement.

The logo or image protruding from the top of the box can be located anywhere on the top of the box. The corresponding convex part of the bottom part of the interfitting box matches the location of the protrusion on the top of the interfitting box in order to create boxes that are stackable. There can be multiple protrusions from the top. The limitation on the amount of the surface of the interfitting box that is devoted to the protrusion is governed by the size of the box, the depth of the box, the desired content of the box, and a sufficient flat area on the top of the interfitting box to assure stackable stability.

The logo or image on the top of the box can be the same item that the interfitting box contains or it can be something entirely different. In the instance of the protrusion, the protrusion can suggest a representation of what the box contains, or it can contain a bonus or enhancement for the rest of the contents of the box.

An interfitting box that takes on a different profile, e.g., the back side of the box is deeper than the front, assures that the configuration provides a higher display profile, enhancing sales, and marketability of the container and the contents.

The principles of the high profile/angled box are the same and the bottom of the interfitting box becomes a cavity that accommodates the top of the interfitting box below. The bottom, including the requisite concave cavity also accommodates the protrusion of the top of the high profile/angled interfitting box. The interfitting box takes on an entirely new form through this design technique and permits an infinite number of designs, styles, quality levels, colors, shapes, and sizes for a variety of products, for virtually any industry.

The attractive interfitting box with the image or logo protruding from the top displays the contents, or suggests the contents to the extent that the interfitting box does not call for always opening the contents to view. In addition, the large areas of flat space on top of the interfitting boxes allow for advertising the contents of the package. Therefore, vendor losses are reduced because pilferage are reduced, and boxes broken into for exposure of contents is reduced.

The interfitting box can be made of any adequate weight, wall thickness, material quality, transparency or opacity, that satisfies the structural requirements of the contents. The inside of the bottom part of the box can have dividers added to isolate the contents. The inside of the bottom part of the box can be lined with other materials or used as produced. The exterior surface of the interfitting box can be smooth, textured, covered, or painted.

The interfitting box can be partially or totally transparent—with or without color. The interfitting box can be partially or completely opaque, or with transparent protrusion or window. The interfitting box can be stamped, molded or injected with intrinsic color, or it can be painted. The interfitting box can be made of a variety of materials within the same box, e.g., plastic box, with coated cardboard dividers inside, and enhanced with a music box.

The interfitting box combines all state-of-the-art packaging technology and adds the element of effective stable stackability of this interlocking, box-to-box, top box to bottom box. The interfitting box does not eliminate the generally accepted use of plastic "windows" on the side or top of a box. The interfitting box can incorporate a "custom molded bubble" that can contain an example of the contents of the interfitting box, a promotion item, or a transparent image or logo.

The interfitting box is versatile: it can be made of any moldable or injectable material; it can be made into any shape; its protrusion can be made into any shape; it can be made into any size; it can be transparent or opaque; there are no limitations to its use; it can be made of unlike materials; and it takes advantage of all prior art.

There are no limitations to the use of this interfitting box within the field of packaging.

The interfitting box has all of the requisite elements for secure stacking stability. The interfitting box provides compact shipping, storage, inventorying and product control, and display. The contents can be one-hundred percent hygienic if desired.

As each of the interfitting boxes is sold or removed, the stack remains as attractive because it still displays the next interfitting box with its attractive protrusion at the top of the stack. The stack can accommodate as many boxes as the depth of each box, the weight of each box, and the location of the interfitting boxes permit.

The interfitting box can be made of any moldable, injectable, or blown material such as glass, plastic, paper, metal, wood, or fabric. The interfitting box can be made in any color or colorless, and or opaque or clear materials. The protrusion on the top of the interfitting box can be virtually any image or logo. The interfitting box can be made of any size, from 1 inch square jewelers "ring boxes" to toy box size boxes. The interfitting box can be made of any quality or thickness. The interfitting box can be covered with paint, paper, fabric, leather, wood, or metal. The interfitting box can be made into any shape, with any protrusion—as long as it does not exceed the size or shape of the supporting interfitting box.

The interfitting box eliminate the requirement for additional individual display or shipping boxes, shelf space in wholesale and retail stores, and additional marketing display pieces. The interfitting box is so stable when stacked that it permits free-standing floor or table displays.

There is more potential to enhance the packaging of a product or an empty interfitting box than with any other state-of-the-art packaging.

Further objects and advantages of my invention will become apparent from a consideration of the drawings and ensuing description.

BRIEF DESCRIPTION OF THE DRAWINGS

FIG. 5 shows a front or back-side view of the box of FIG. 1, in assembled condition.

FIG. 7 shows a cutaway view of one assembled, interfitting box.

FIG. 8 shows the interlocking fitting of the top of the box to the bottom of the box.

FIG. 9 shows the interlocking fitting of the bottom of the box to the top of the box below at the corresponding beveled edges that surround the top and the bottom.

FIG. 10 shows a series of three assembled, interfitting boxes from a cutaway view.

REFERENCE NUMERALS IN DRAWINGS

Figure 1:
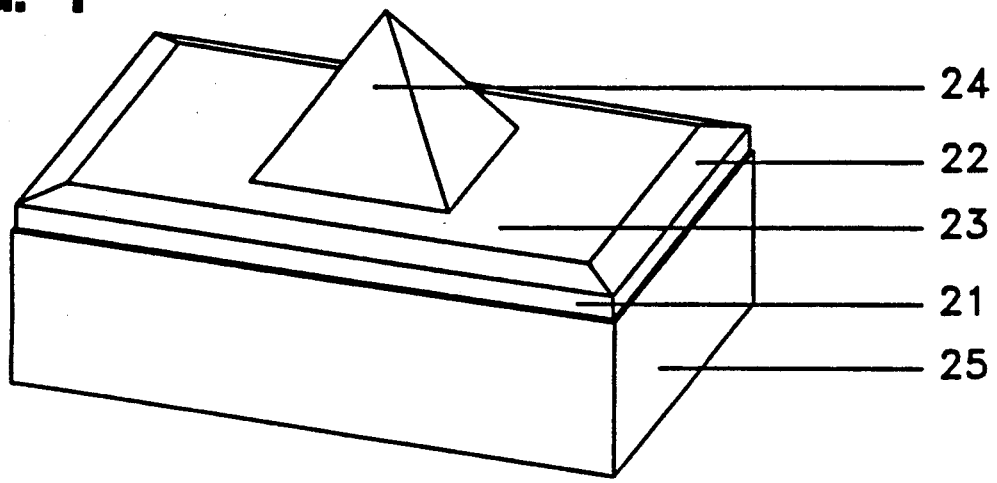
FIG. 1 shows a perspective view of an assembled flat interfitting box in accordance with the invention with a pyramidal (as an example) protrusion on top of a beveled top that is otherwise flat.

21. Sides of Top
22. Beveled edge of each side of top
23. Flat surface of top surrounding protrusion
24. Image, logo, or generic protrusion
25. Sides of Bottom
26. Beveled edge of each side of bottom panel
27. Flat surface of bottom panel surrounding protrusion
28. Image, logo, or generic protrusion on bottom panel
29. Empty space within bottom
30. Empty cavity within bottom convex/concave protrusion
31. Fitting interlock of assembled box—top to bottom
32. Fitting interlock of a box bottom above with a box top below
33. Front slope of surface of an angled top
34. Back side of front slope surface of an angled top
35. Sides of an angled top
36. Shelf slope of angled bottom
37. Back supporting side of shelf slope of angled bottom
38. Sides of shelf slope of angled bottom
39. Sides on the shelf slope of angled bottom

DESCRIPTION—FIGS. 1 TO 18

An interfitting image display box, FIG. 1, is illustrated here as a rectangle with an example of a pyramidal protrusion 24, to demonstrate one innovative concept. The interfitting box can be any shape, any size, and can have any protrusion design. A top with sides 21, a protrusion 24, a flat surface surrounding said protrusion 23, and a beveled edge at each side 22. A bottom that takes on a corresponding shape to a top to enable the boxes to fit together when assembled one on top of the other.

Figure 2:
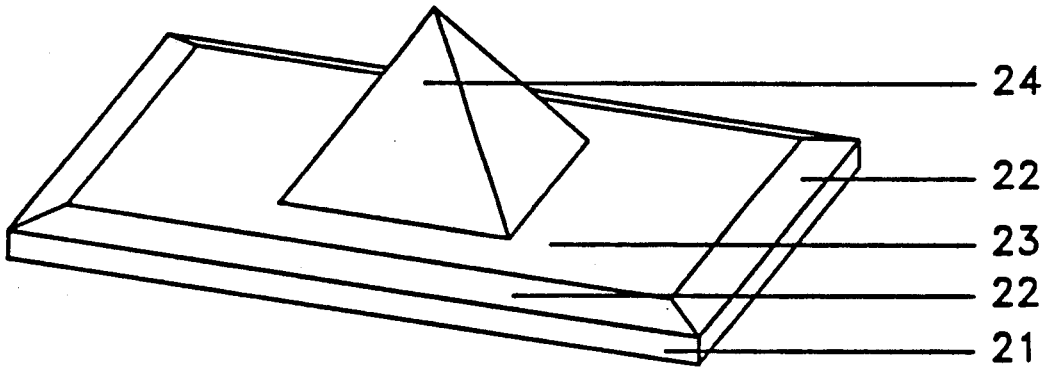
FIG. 2 shows a top perspective view of a box top of FIG. 1, with a convex beveled edge, a flat display surface, and a convex protrusion.

FIG. 2 shows a top of a box from a top perspective. A box top is attractive even when disassembled and set aside from a bottom.

Figure 3:
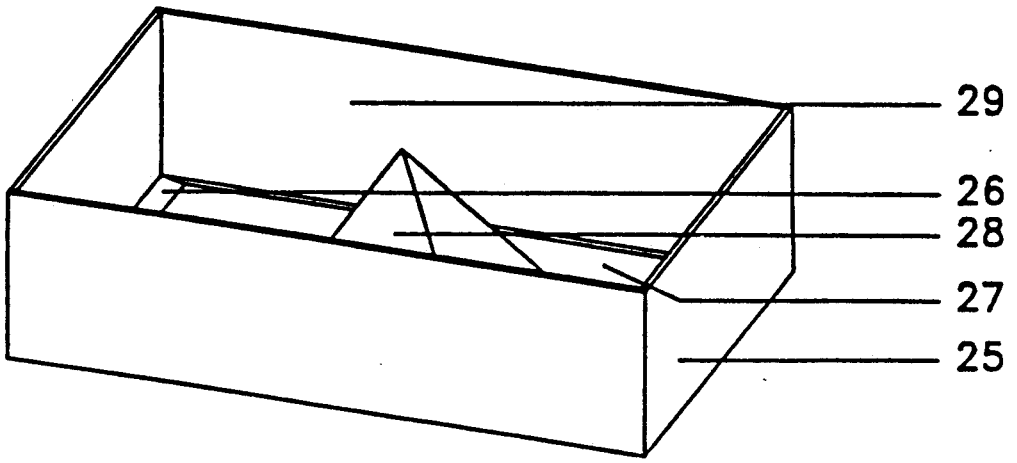
FIG. 3 shows a top perspective of the bottom with upright sides providing an empty container, and on the bottom panel a convex beveled edge, a flat surface surrounding a convex protrusion, and a convex protrusion.
Figure 4:
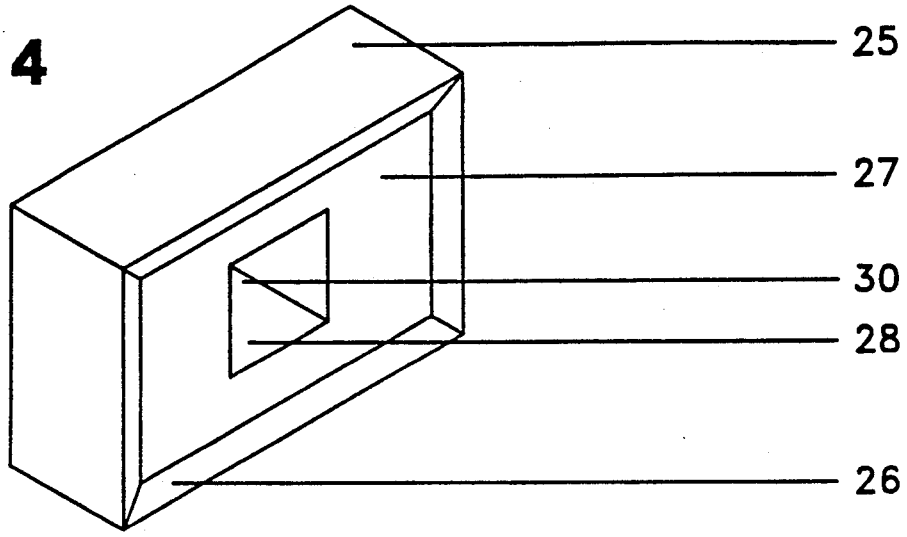

FIG. 3 shows a top perspective view of a bottom with an empty space 30 within upright sides 25, and a bottom panel surrounding a convex protrusion 28, a beveled edge at all sides 26, and a flat surface 27 around said protrusion 28. The bottom perspective view of a bottom FIG. 4, shows upright sides 25, a beveled edge at all edges 26, and a flat surface 27, surrounding said concave protrusion 28.

Figure 5:
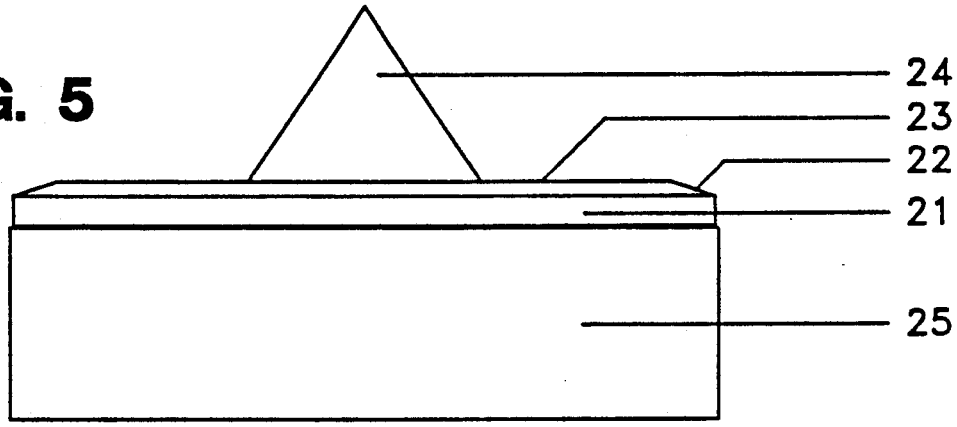
FIG. 5 shows a bottom view of a bottom part of a box of FIG. 1, with a concave beveled edge, a flat surface surrounding a cavity, and a concave cavity.
Figure 6:
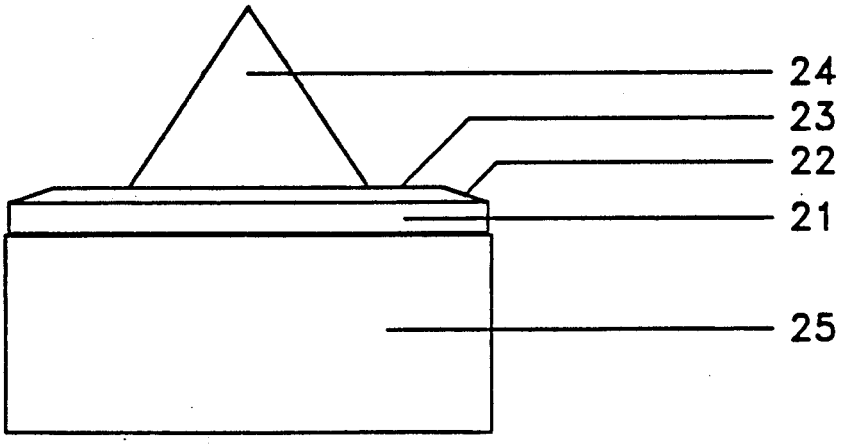
FIG. 6 shows a side view of the box of FIG. 1 in assembled condition.

A typical embodiment of the assembled interfitting box is illustrated in FIG. 1 (top view), FIG. 5 (front or back view), and FIG. 6 (side view). These views show an assembled box with a top, and a bottom from the perspective of the sides.

FIG. 7 shows how a top and a bottom of a box fit together 31 with a top lip that interlocks with a bottom lip. A protrusion 24 (here a pyramid on top of a box), a flat surface on top of a box 23, a convex beveled edge 22 on each side of a box top, and multiple sides 21. A bottom with multiple sides 25, a beveled edge 26 on all edges of a bottom panel, a flat surface on a bottom panel 27, surrounding a protrusion 28, which is a concave/convex protrusion located on a bottom panel creating a bottom outside cavity 30, enclosing an empty space 29 for a product.

FIG. 8 illustrates the fitting of the top of a box to the bottom of a box creating an interlocking effect 31. This fit eliminates the need for the top of a box to fit down over the bottom of a box when assembled.

FIG. 9 illustrates a fitting of the top of a box below into the bottom of a box above 32. The beveled edge 22, 26, reduces slipping of a stack of boxes during handling and shipping.

FIG. 10 shows a cutaway view of a stack of assembled boxes, view from the front or back, illustrates the interfitting box concept. The manner in which top of said box below fits into the base of the bottom of said box above 32 creating a stack provides the interlocking, stabilizing function of the design.

Figure 11:
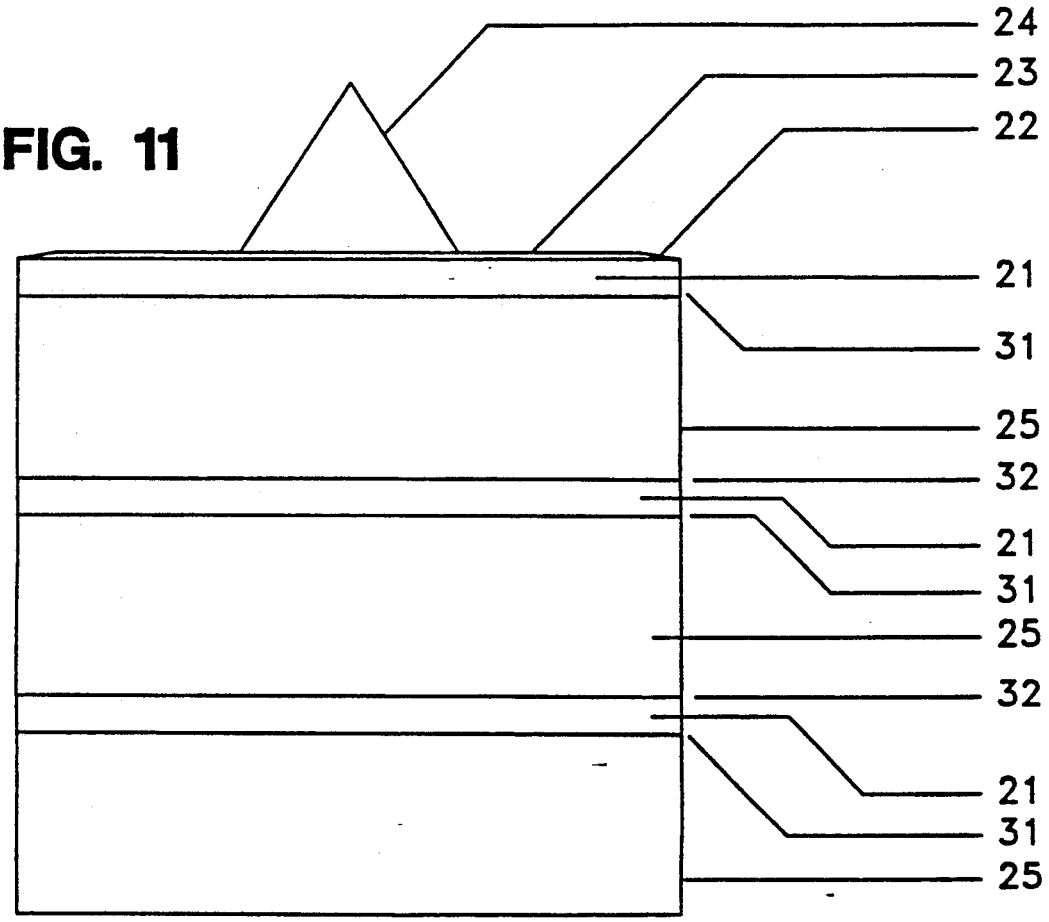
FIG. 11 shows a stack of three assembled, interfitting boxes as they would appear in a display.

FIG. 11 shows how a stack of interfitting boxes appears for display. Only the top box displays the unique top configuration box with its image or logo protrusion. The size of the box determines the number of interfitting boxes that can be securely stacked. In the event that a stack of boxes will be displayed on a floor, a self-pallet (not shown) secures the stack and protects the bottom box from damage. For shipping, a top shipping cap (not shown) protects the top box. An entire assembly can then be placed in a shipping master box: self-pallet on the bottom, a a series of boxes placed one on top of the other, and a cap can be placed over the top box. A shipping box (not shown) can then be closed and sealed with assurance that the contents are protected.

A top protrusion, here shown as a pyramid, can be a mechanical item such as a car, a natural phenomenon such as a mountain, a man-made configuration such as a building, a figure such as a person, or a figurine such as a robot (not shown). For example, a pyramid can suggest a souvenir from Egypt, a game, or promote a trip.

Figure 12:
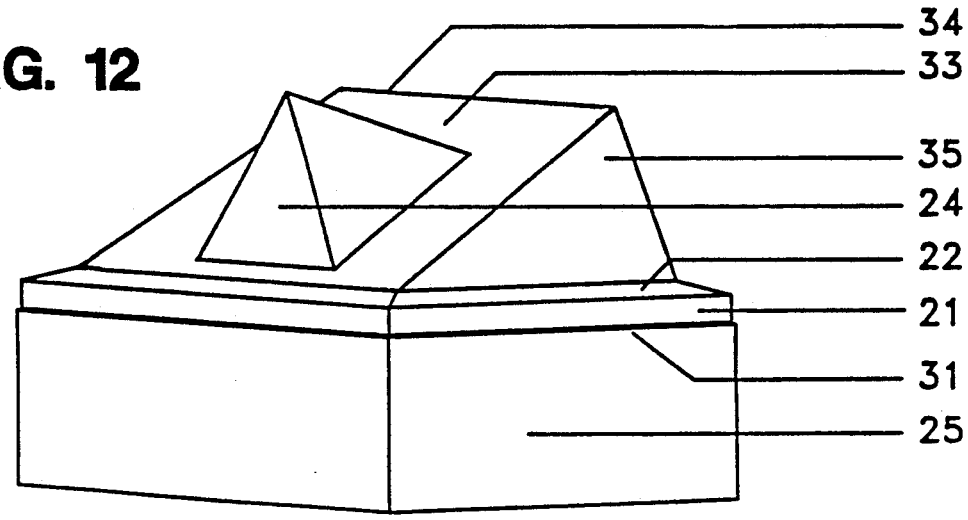
FIG. 12 shows a perspective view of an assembled angled interfitting box.

FIG. 12 illustrates a higher profile/angled version of an assembled angled interfitting image display box. This version of a box is deeper in back than in the front. A slope 33, with a back side 34, and sides 35, also has an image or logo protrusion 24 on the top of a box. A slope permits an assembled box to display well even on a shelf. This version of a box has the same beveled surface at the edges 22 on a top and the sides of a top 21 and a bottom 25.

Figure 13:
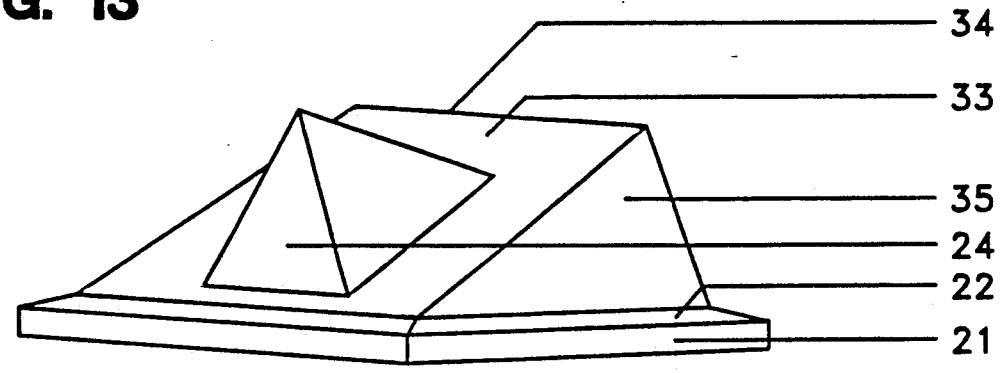
FIG. 13 shows a top perspective view of an angled interfitting box top.

FIG. 13 shows the top of an angled interfitting box. A top is also attractive when removed from a bottom.

Figure 14:
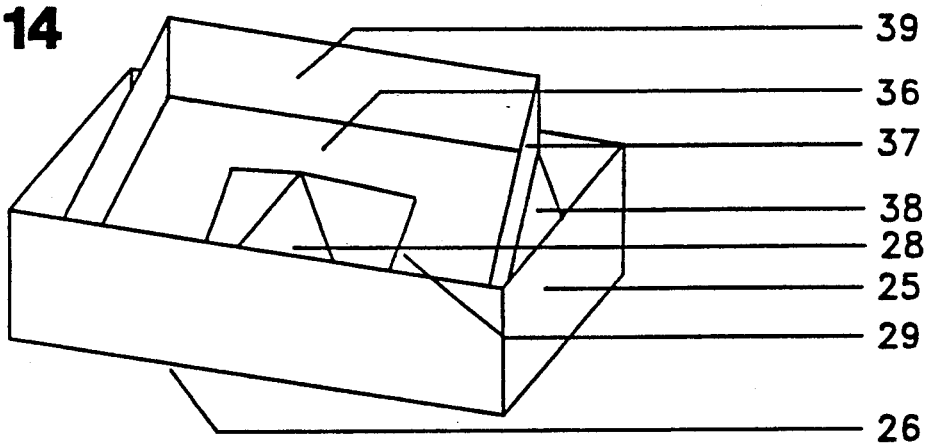
FIG. 14 shows a top perspective view of an angled interfitting box bottom.
Figure 15:
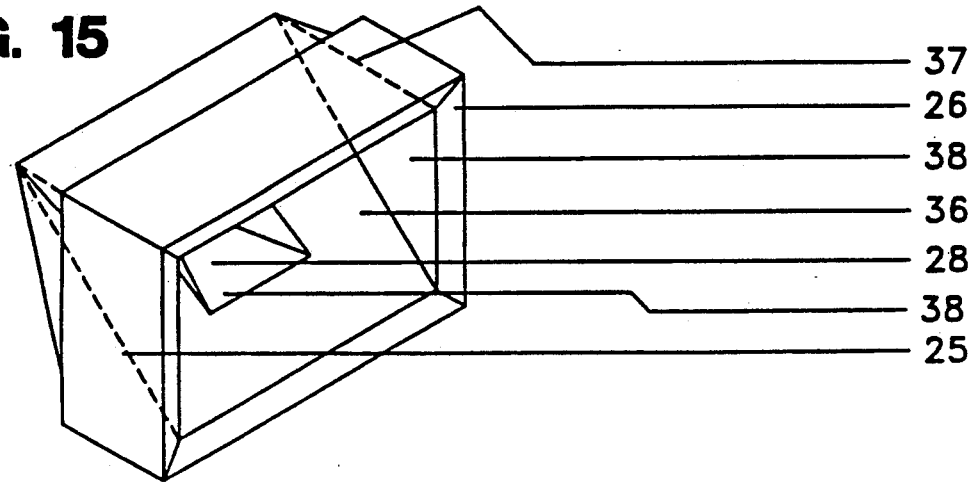
FIG. 15 shows a bottom perspective view of an angled interfitting box bottom.

FIG. 14 shows a top view of an inside of a bottom of an angled interfitting box illustrating the convex sloped shelf of a bottom panel 36, with a back side 37, slope support sides 38, and product enclosing sides 39. The surface of a bottom of an angled box also has convex beveled edges 26, a flat surface 27, and a protrusion 28. An angled box bottom is illustrated in a view from the bottom view of said bottom, FIG. 15. A concave slope 36, with a back side 37, and sides 38, a concave cavity 28, and a concave beveled edge 26 on all sides interlocks with an angled box top of a box below when stacking a series of assembled angled boxes.

Figure 16:
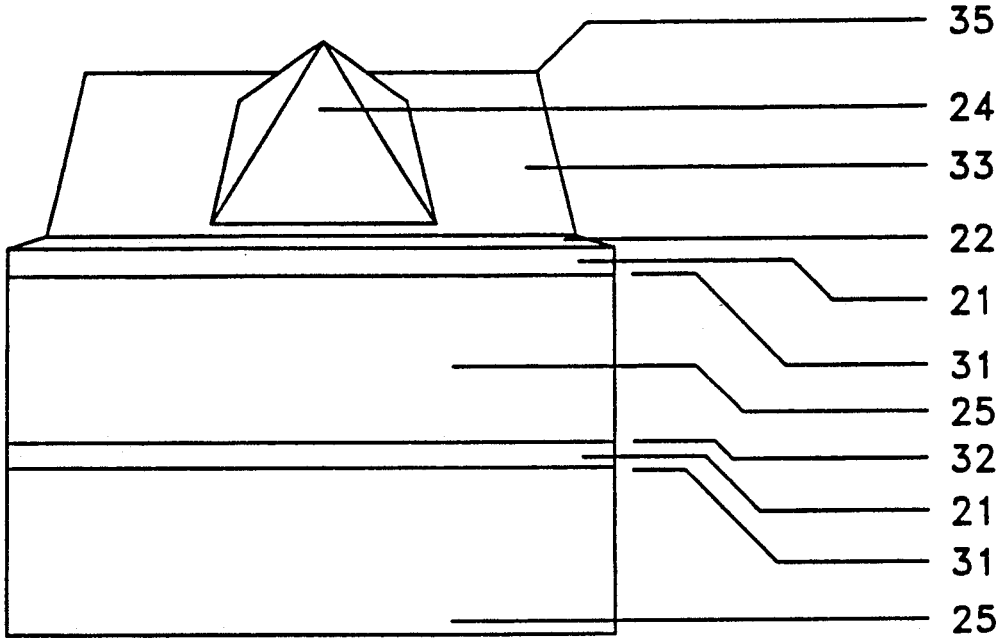
FIG. 16 shows a stack of assembled angled interfitting boxes.

Therefore, when stacked one on top of the other, several angled interfitting boxes FIG. 16, interlock leaving only the slope 33, with a back side 34, and sides 35, beveled edges 22, and a protrusion 24, of the top angled interfitting box visible, along with the sides 21, 25 of the assembled tops 21 and bottoms 25 of each box stacked below.

Figure 17:
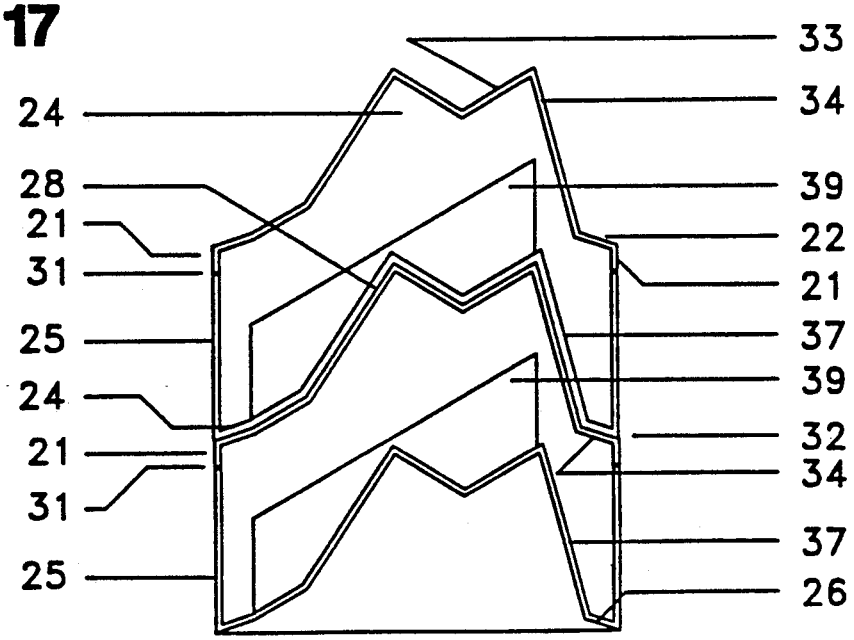
FIG. 17 shows a cutaway side view of a stack of assembled angled interfitting boxes.

The cutaway side view of two angled interfitting boxes is graphically shown in FIG. 17. In order to accommodate the slope of the top angle 33 and its protrusion 24, to provide vertical sides 21, 25 (avoiding tipping of the stack because of the acute angle of the top), and to assure stackable stability, the beveled edges 22, 26 minimize the adjustments of the angle of the sides of the top of the angled interfitting box. When the top of an assembled angled box is removed from its bottom, the high profile angle and protrusion image are unchanged.

Figure 18:
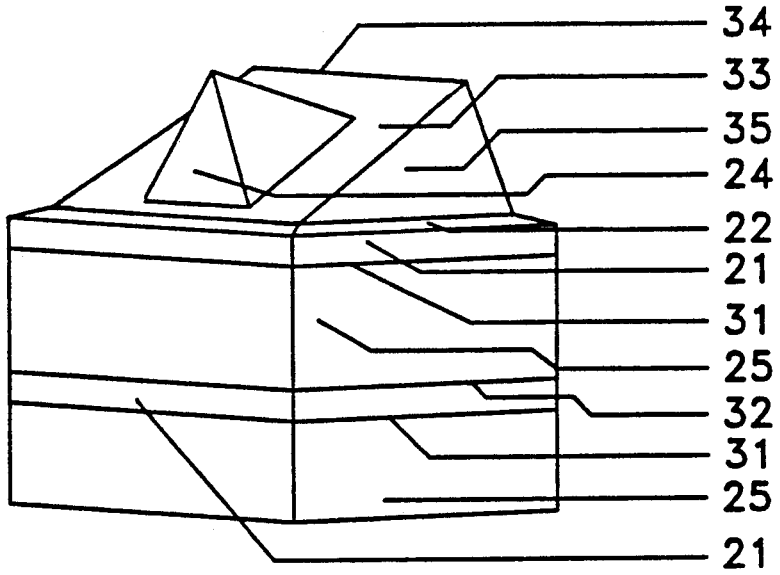
FIG. 18 shows 2 assembled angled interfitting boxes stacked together as they would appear in a display.

FIG. 18 illustrates how, when assembled, a stack of angled interfitting boxes interlock, just as with the first version discussed above; leaving the top of the top box only for attractive display. The interlocking feature assures stability of a stack of these unique boxes.

OPERATION—FIGS. 8, 9, 10, 17

The interfitting boxes are designed to provide an interlocking fit between a top below to a bottom of a box above.

As shown in FIG. 8, a top is slotted outward at the lip of each side, and a bottom is slotted inward at the lip of each side. This configuration provides a locking arrangement that does not interfere with a top of a top or of a bottom of a bottom parts of a box. Nor does it require the overlap of top sides over bottom sides of a conventional box.

FIGS. 12 and 17, show a top 13 and a bottom 14 of an assembled angled interfitting box. This is the same configuration for the fitting of the top to the bottom as that of FIGS. 2 and 7. This fitting is sufficient to assure a secure locking of the top to the bottom of the angled interfitting box.

Angled interfitting boxes also fit a top into a bottom of an angled interfitting box above, one after the other until a stack is created FIG. 17. The configuration of the tops with their flat surfaces 23, 36, convex bevels 22, 26, and convex protrusions 24, 28. Of both a flat interfitting box FIG. 1 and an angled interfitting box FIG. 12, and their respective bottoms with their corresponding flat or sloped surfaces, concave bevels, and concave cavities, assures an interlocking device for a stable stack of interfitting boxes.

A top protrusion is always a true representation of the image or logo desired, e.g., a pyramid as shown in FIG. 1. The bottom concave cavity need not necessarily be a true representation of the image or logo desired FIGS. 3, 4. Because of the accuracy with which each interfitting box is designed, the bottom concave cavity is positioned perfectly and of the correct size to accommodate the protrusion of the top of the box below in a stack of assembled interfitting boxes. The generic bottom concave cavity does not diminish the stability of the stacking of the interfitting boxes. Where the inside (of the bottom part of the box) convex cavity FIG. 3, is a true representation of the image or logo presented as the protrusion on the top part of the interfitting box, the interlocking feature is slightly tighter.

DETAILED DESCRIPTION OF THE PREFERRED EMBODIMENT

The interfitting image display box is made of a top with a protrusion on top that is an image or a logo that suggests the contents of the interfitting box, and a bottom into which the top seats and which embodies a convex cavity of a size and shape to accommodate and seat with the top of an interfitting box below.

The angled interfitting image display box is deeper in the back than in the front, or side to side, is made of a top with protrusion(s) on top, and which top slopes upward from the front to the back, or side to side, or front down to middle, or up to middle and down or up to back, or side down to or up to middle up to side, so that the back of the interfitting box or one side or the other is deeper than the front or the other side that seats into a bottom that embodies a sloped bottom and a concave cavity of a size and shape to accommodate and seat with the top of the interfitting box below, and, which leaves sufficient space inside of the bottom of the interfitting box to accommodate the desired contents of the interfitting box.

Each of the interfitting image display boxes fits onto the one below it until the top box is the display box representative of the entire stack. The protrusion on the top and each box is the image or the logo representation that is molded onto, or molded as part of the top part of the interfitting box. The convex cavity in the bottom part of the interfitting box, accommodates the protrusion of the top part of the interfitting box stacked beneath it, creating an interlocking stack of as many boxes as desired.

SUMMARY OF THE INVENTION

The subject invention is a molded set-up box with a top and a bottom, a top having a protrusion representing any image or logo that enhances the box and suggests the content of the box, and a bottom that has a concave cavity that receives the protrusion of the top of the box below and interlocks the boxes one on top of the other for the desired number of boxes in the stack, until the top box is the display box. As the top box is lifted off the stack, the next box becomes the display box.

The interfitting box may be used to contain any product. The interfitting box may be made of any moldable, injectable, or blown material that can be shaped subject only to restrictions such as weight flexibility, availability, and design.

I claim:

1. An interfitting image display box, comprising:

a top cover, comprising a somewhat flat top panel and a plurality of side panels extending down from said top panel so as to surround a space below said top panel, said side panels and said top panel forming a shallow cup-shaped member with beveled edges capable of being conformingly mated to the underface of another said image display box;

said flat top panel including a a protrusion extending upwardly from said top panel, the area of said protrusion, when seen from a direction normal to said top panel, being a minor part of the area of said top panel, said protrusion being shaped to indicate the nature of articles which are contained in said image display box;

a plurality of side panels, said side panels having a lower margin with an indentation permitting interlocking with a bottom panel;

a bottom box portion, comprising a somewhat flat bottom panel and a plurality of bottom side panels extending upward from said bottom panel so as to surround a space above the surface of said bottom panel, said bottom panel having a margin area on its lower surface, around its perimeter, bevel-shaped inwards and upwards, causing the greater portion of its lower surface to be recessed upward, so that said bottom box portion can be conformingly mated to said top cover of an image-display box;

said bottom panel including a protrusion extending inwardly and upwardly above said bottom panel when seen from a direction facing and normal to the bottom surface of said bottom panel, said protrusion cavity being sized and shaped to permit easy mating with said protrusion of said top panel, said protrusion, when seen from a direction normal to said bottom panel, forming a minor part of the area of said bottom panel;

said interfitting image display box being made of any material capable of being formed into the required shapes of said cover, sides and box-bottom; said box being capable of being stacked on other image display boxes in a nesting manner and visually indicating by the shape of its cover protrusion, the nature of articles contained in said box.

2. The image-display box of claim 1 wherein said protrusion in said top cover is transparent; said transparent protrusion permitting any article inside said box to protrude and be seen from outside said box.

3. The image-display box of claim 1 wherein said protrusion in said top cover is opaque and is a molded illustration of at least a portion of an article which is contained in said box, so that the nature of said article can be determined fro the outside of said box.

4. The image-display box of claim 1 wherein said protrusion in said top cover includes a molded rectangular bar surface suitable for applying advertising of the contents of said box.

5. The image-display box of claim 1 wherein said top cover comprises a top panel having a sloping portion which has one edge raised well above a horizontal portion of said cover, said sloping portion being at an angle of 30 to 40 degrees with the horizontal, and a plurality of side panels extending from said top panel so as to surround a space below said top panel, said side panels and said panel portions forming a shallow cup-shaped member with a beveled edge perimeter, that can be conformingly mated to the underface of another said image-display box;

said sloping portion of said top panel including a protrusion extending upwardly from said top panel, the area of said protrusion, when seen from a direction normal to said top panel, being a minor part of the area of said top panel, said protrusion being shaped to indicate the nature of articles which are contained in said image-display box.

6. The image-display box of claim 1 wherein said bottom panel includes an upwards sloping portion, recessed in said panel; said upwards sloping portion allowing said box to be placed on and conformingly mated to an image-display box having an upwards sloping top.

* * * * *